US009084054B2

(12) United States Patent
Prelogar et al.

(10) Patent No.: US 9,084,054 B2
(45) Date of Patent: Jul. 14, 2015

(54) EAR JEWELRY WITH WIRELESS AUDIO DEVICE

(71) Applicants: Barrett Prelogar, Lake Ozark, MO (US); Patsy Prelogar, Lake Ozark, MO (US)

(72) Inventors: Barrett Prelogar, Lake Ozark, MO (US); Patsy Prelogar, Lake Ozark, MO (US)

( * ) Notice: Subject to any disclaimer, the term of this patent is extended or adjusted under 35 U.S.C. 154(b) by 21 days.

(21) Appl. No.: 13/835,975

(22) Filed: Mar. 15, 2013

(65) Prior Publication Data

US 2013/0287241 A1 Oct. 31, 2013

Related U.S. Application Data

(60) Provisional application No. 61/640,303, filed on Apr. 30, 2012.

(51) Int. Cl.
*H04R 25/00* (2006.01)
*H04R 1/10* (2006.01)
*H04R 1/02* (2006.01)

(52) U.S. Cl.
CPC ..... *H04R 1/105* (2013.01); *H04R 1/028* (2013.01); *H04R 1/1066* (2013.01); *H04R 2201/023* (2013.01); *H04R 2420/07* (2013.01)

(58) Field of Classification Search
USPC ..... 381/374, 380
See application file for complete search history.

(56) References Cited

U.S. PATENT DOCUMENTS

| | | | |
|---|---|---|---|
| 2,506,116 | A | 5/1950 | Starkey |
| 2,909,619 | A | 10/1959 | Hollingsworth |
| 5,533,130 | A | 7/1996 | Staton |
| 5,812,680 | A | 9/1998 | Glendon |
| 5,828,757 | A | 10/1998 | Michalsen et al. |
| 6,493,453 | B1 | 12/2002 | Glendon |
| 7,013,018 | B2 | 3/2006 | Bøgeskov-Jensen |
| 7,206,429 | B1 | 4/2007 | Vossler |
| 7,536,150 | B2 | 5/2009 | Ryann |
| 8,086,288 | B2 | 12/2011 | Klein |
| 2002/0039427 | A1 | 4/2002 | Whitwell et al. |

(Continued)

FOREIGN PATENT DOCUMENTS

| | | | |
|---|---|---|---|
| CN | 201142755 | Y | 10/2008 |
| CN | 201523441 | U | 7/2010 |
| WO | 2005053352 | A1 | 6/2005 |

OTHER PUBLICATIONS

Blog dated Oct. 12, 2009 for hearing aid by Design Affairs Studio.

*Primary Examiner* — Davetta W Goins
*Assistant Examiner* — Amir Etesam
(74) *Attorney, Agent, or Firm* — Erickson, Kernell, Derusseau & Kleypas, LLC

(57) ABSTRACT

An audio device worn in a piercing in an ear of a user. The audio device extends through the piercing and includes a wireless communications unit disposed at a first end and a sound-production unit coupled to an opposite second end thereof. The signal path from a master device to the sound-production unit for producing audio outputs thus passes through the pinna of the ear. The sound-production unit may include an ornamental cover such that the device can be worn as jewelry. The speaker and the wireless communications unit may be removable from a body of the device to enable the body to be worn alone as jewelry and to allow replacement of the wireless communications unit with a wired connection. The device may include a control surface useable to provide inputs to the master device coupled to the device.

22 Claims, 12 Drawing Sheets

(56) References Cited

U.S. PATENT DOCUMENTS

| | | | | |
|---|---|---|---|---|
| 2007/0058831 | A1 | 3/2007 | Rie | |
| 2008/0044002 | A1 | 2/2008 | Bevirt et al. | |
| 2008/0075316 | A1* | 3/2008 | Chan | 381/381 |
| 2009/0202096 | A1* | 8/2009 | Ryann | 381/374 |
| 2012/0052922 | A1 | 3/2012 | Li | |
| 2012/0308069 | A1* | 12/2012 | Stott | 381/380 |

* cited by examiner

EAR JEWELRY WITH WIRELESS AUDIO DEVICE

CROSS-REFERENCE TO RELATED APPLICATIONS

This application claims priority to U.S. Provisional Patent Application No. 61/640,303, filed Apr. 30, 2012 and entitled "Headphone Apparatus", the disclosure of which is hereby incorporated herein it its entirety by reference.

BACKGROUND

Piercing of various parts of the body for insertion of jewelry has been conducted by humans for thousands of years for a variety of reasons. Some piercings are completed for religious or spiritual beliefs and ceremonies while others are for ornamental purposes. The most common piercings are those in lobes of the ears, but a variety of other locations both in different parts of the ear as well as other parts of the body are not uncommon. For example, ear piercings are commonly formed in cartilaginous parts of the ear like the helix, concha, or tragus, among others.

Common earrings include a thin stud that is inserted through the lobe of the ear and retained in place by a clutch installed thereon. However, some subcultures or piercing "purists" employ larger body jewelry that requires or forms much larger piercings in the lobe or other portions of the ear. The body jewelry worn in these piercings is often held in place without the use of a clutch or other fastener and may require insertion into a piercing by stretching the piercing to allow passage of an enlarged end of the jewelry and then allowing the piercing to shrink or return to an original size to retain the jewelry therein.

These body jewelry pieces are available in a variety of types. One type of body jewelry that is often used in cartilaginous parts of the ears is referred to as an industrial piercing. The industrial comprises an elongate rod with enlarged ends that is typically disposed to extend through a pair of piercings in the upper portion of the ear. Another form or variation of an industrial piercing is a spiral piercing which includes a spiral shaped body that is disposed in two or more piercings in the ear and may spiral or wrap around an edge or the scapha of the ear.

Gauge-style earrings comprise piercings in which a small initial piercing is created through, for example, the lobe of the ear. The piercing is then expanded or stretched over time by placing incrementally larger earrings therein. These earrings are referred to by their diametrical size measured using the American Wire Gauge (AWG) standard or in millimeters. Such earrings include those referred to as a taper and a gauge. A taper typically includes a body that is larger at one end than the other. An enlarged ball or similar feature may be disposed at the point thereof. The taper may be employed to slowly expand the piercing. The weight of the taper can apply a stretching force on the piercing as a result of the expanding shape of the taper as it is pulled through the piercing. Gauge-style earrings generally comprise a ring, also known as a tunnel, or a plug that is disposed within the piercing.

Piercings and/or clamps or wraps have also been employed to support audio devices, such as hearing aids and speakers, on the ear of a user. For example, U.S. Pat. No. 8,086,288 to Klein describes a wireless earring headset that is attached to the lobe of a user's ear via a stud extending through a small piercing in the user's ear and held in place by a clutch or clasp coupled to the stud. The headset includes a speaker that is directed toward the user's ear canal and a microphone disposed on a boom directed toward the user's mouth. This configuration with the large body and the microphone boom extending therefrom may be found by users to be bulky and unattractive for wearing in public or in a social setting.

U.S. Pat. No. 7,536,150 to Ryann describes a wireless earpiece assembly configured to give the appearance of an earring. The assembly is attached to the lobe of the user's ear via a stud or clasp which fully supports the assembly. Other contact with the ear is avoided to reduce discomfort caused by long-term use. The assembly includes a coupling mechanism or hoop on which a speaker and a casing are disposed. The speaker is positioned to direct sound toward the user's ear canal and the casing is suspended from the coupling mechanism and houses operational components of the assembly. Although, the configuration described by the '150 patent is ostensibly designed to resemble an earring, the speaker is fully visible and disposed adjacent the ear of the user during wearing of the assembly.

U.S. Patent Application Publication No. 2012/0308069 to Stott describes a gauge-style piercing with a speaker disposed therein. The speaker is directed outwardly and away from the user's ear to enable the user to hear audio outputs therefrom while also retaining the ability to hear sounds from their surroundings and environment. The '069 publication teaches that such a configuration is necessary to ensure the safety of the user and to avoid bulky or uncomfortable headphones that are placed in the user's ear canal and that block out environmental noises. However such a configuration broadcasts the audio outputs to the user's surroundings which may be unwanted by the user or by those nearby.

A need exists for body jewelry disposable in a piercing and with an integral audio device that can be disguised as ornamental jewelry when not used as an audio device. A need also exists for such a device that is configured for gauge and cartilaginous piercings.

SUMMARY

Embodiments of the invention are defined by the claims below, not this summary. A high-level overview of various aspects of the invention are provided here for that reason, to provide an overview of the disclosure, and to introduce a selection of concepts that are further described in the Detailed-Description section below. This summary is not intended to identify key features or essential features of the claimed subject matter, nor is it intended to be used as an aid in isolation to determine the scope of the claimed subject matter. In brief, this disclosure describes, among other things, a device that is wearable in an ear piercing as body jewelry and that includes an integral audio device.

The device includes a body with a wireless communications unit and a sound-production unit, such as a speaker or transducer coupled thereto. The wireless communications unit is connected to a first end of the body and transmits audio output signals through the body to the sound-production unit. The sound-production unit is coupled to the opposite second end of the body via a flexible conduit to allow the sound-production unit to be placed in proximity to or at least partially in the ear canal of the user when listening to audio output. When listening is not desired, the sound-production unit can be covered by an ornamental cover and suspended from the second end of the body or disposed within the body.

The wireless communications unit may be detachable from the body to enable a wired connection to be made to the body. The wireless communication unit, the body, and/or the sound-production unit might also include one or more input surfaces that can be manipulated by a user to control a master device that is coupled thereto.

DESCRIPTION OF THE DRAWINGS

Illustrative embodiments of the invention are described in detail below with reference to the attached drawing figures, and wherein.

DETAILED DESCRIPTION

Figure 1:
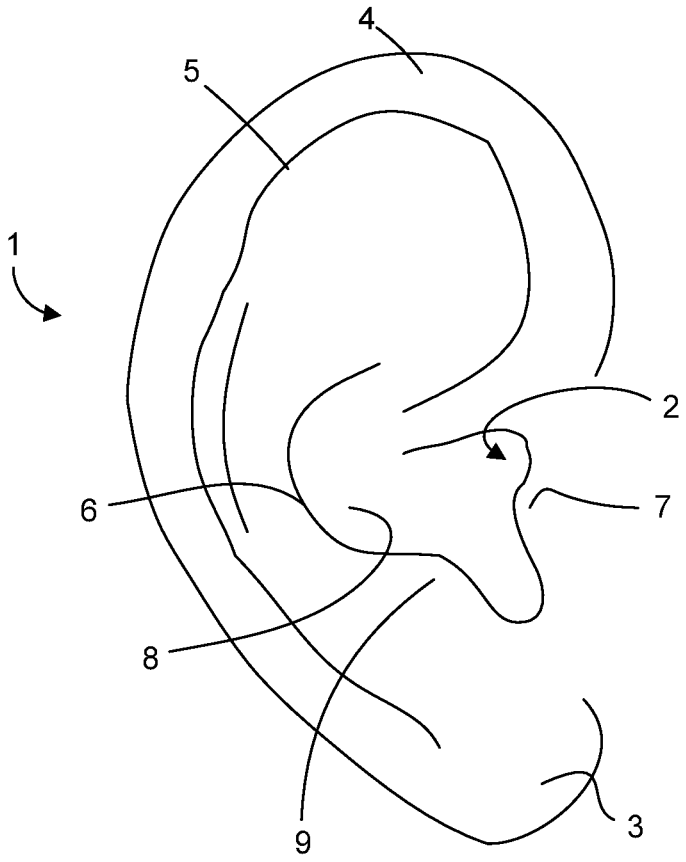
FIG. 1 is a diagram depicting the pinna or outer portion of a human ear and parts thereof.
Figure 2:
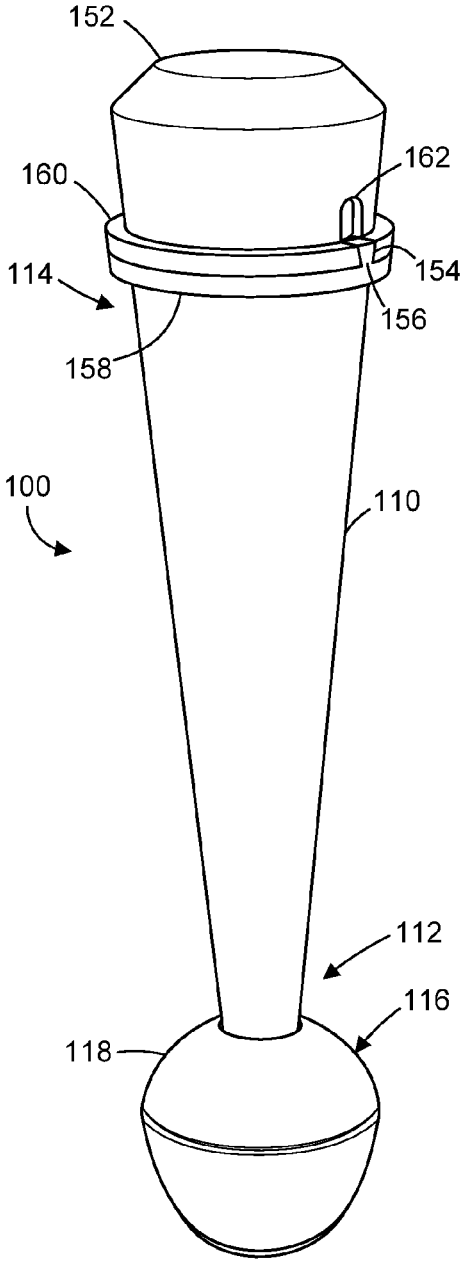
FIG. 2 is a perspective view of an audio device configured as a taper-style earring depicted in accordance with an embodiment of the invention.

The subject matter of select embodiments of the invention is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described.

Embodiments of the invention are described herein with respect to the drawings in which reference numerals are employed to identify particular components or features. Corresponding elements in the various embodiments depicted are provided with reference numerals having matching second and third digits but with differing first digits, e.g. element 10 corresponds to elements 110, 210, etc. Such is provided to avoid redundant description of corresponding features of the elements but is not intended to indicate the features or elements are necessarily the same.

With initial reference to FIG. 1, an external portion or pinna 1 of a human ear is depicted. The pinna 1 comprises a soft appendage generally comprised of cartilage and soft or fleshy tissues that collect and direct sound toward the ear canal 2 for receipt by the inner ear as known in the art. A variety of portions of the pinna 1 may be pierced for insertion of body jewelry. For example, the lobe 3 comprises fleshy tissues such as skin, and may be pierced for insertion of an earring or body jewelry such as a taper- or gauge-style earring. Hereinafter, earrings and body jewelry that are insertable in a piercing in the pinna 1 are collectively referred to as earrings. The helix 4, scapha 5, antihelix 6, tragus 7, concha 8, and antitragus 9 are a cartilaginous portions of the pinna 1 that can be pierced for insertion of earrings known as an industrial, spiral, rook, tragus, and conch, among others.

With reference now to FIGS. 2-8, an audio device 100 that is wearable in a piercing in the pinna 1 of the ear is described in accordance with an embodiment of the invention. The audio device 100 is configured as a taper-style earring and includes a body 110 having a generally conical form. The conical form provides a first end 112 of the body 110 with dimensions that are smaller than those of an opposite second end 114. Although the body 110 is described herein as including a linear or straight conical taper-style form, it is to be understood that the body 110 can take a variety of different taper-style forms including for example, curved, spiral, claw, or horn shaped tapers among others. The body 110 includes a substantially hollow interior space and is removeably coupled at the first end 112 to a control unit 116.

The control unit 116 includes a housing 118 having dimensions larger than the first end 112 of the body 110, e.g. the housing 118 has a diameter that is larger than the diameter of the first end 112 of the body 110, but the housing 118 can have any desired dimensions—larger or smaller than those of the body 110. The housing 118 is preferably configured in a spheroidal form but any desired form can be employed. The size and shape of the housing 118 may aid in avoiding inadvertent withdrawal of the audio device 100 from the piercing. Other components might also or alternatively be employed to avoid inadvertent withdrawal and/or to maintain positioning of the body 110 in the piercing, such as rubber o-rings.

Figure 5:
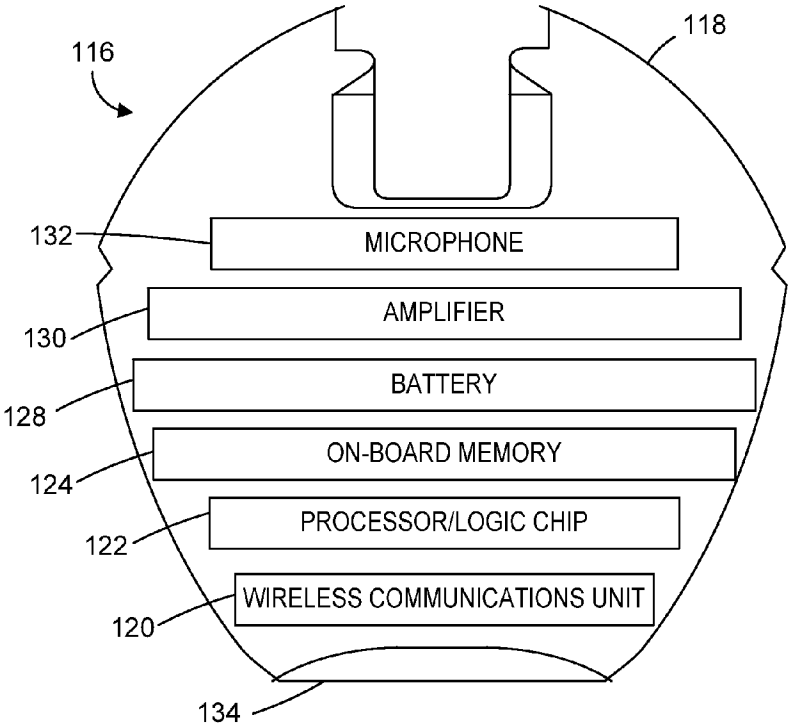
FIG. 5 is a block diagram depicting components of a control unit of an audio device depicted in accordance with an embodiment of the invention.

As depicted in FIG. 5, a variety of components are disposed in the housing 118 and configured for operation of the audio device 100 including a wireless communications unit 120, a processor or logic chip 122, an on-board memory 124, and a battery 128. An amplifier 130 and a microphone 132 might also be included, among a variety of other components. It is to be understood that one or more of these components can be combined or their functions performed by another component. For example, processors can include memory. Additionally, detail of the connections and communications between the components is not necessary for conveying an understanding of embodiments of the invention and is not described in detail herein.

Figure 7:
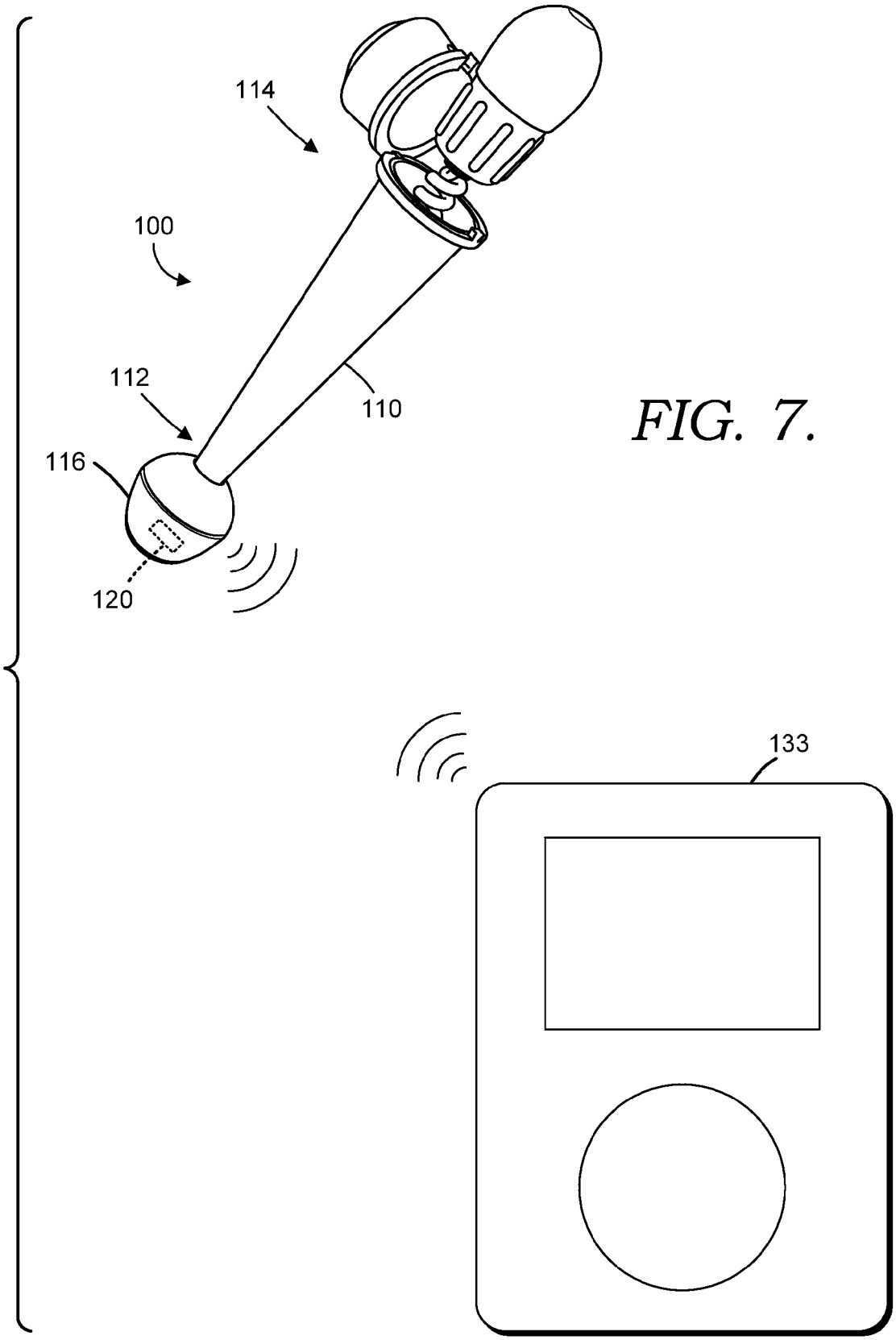
FIG. 7 is a diagrammatic view of wireless communications between a wireless communications unit disposed in a control unit of the audio device of FIG. 2 and a master device depicted in accordance with an embodiment of the invention.

The wireless communications unit 120 employs wireless communications protocols, standards, hardware, and the like, available in the art, such as, for example, the BLUETOOTH standards developed by the Bluetooth Special Interest Group. As shown in FIG. 7, the wireless communications unit 120 in the control unit 116 provides wireless communications between the audio device 100 and a master device 133 such as a digital music player, a cellular telephone, a computer, or similar electronic device. The master device 133 provides audio data, and control signals, among other communications to the audio device 100 via wireless communications with the wireless communications unit 120 for use by the audio device 100. The audio device 100 may also transmit a variety of communications to the master device 133 via the wireless communications unit 120 like, for example, handshake signaling for creating a secure connection therebetween, audio data collected by the microphone 132, or command signals to the master device 133, e.g. to change an audio file being played, among others.

The processor or logic chip 122 executes one or more programs or routines useable to produce an audible output using audio data received from the master device 133 via the wireless communications device 120. The processor 122 may process audio inputs received from the microphone 132 for communication to the master device 133. Additionally, one or more control surfaces 134 can be provided on the audio device 100 from which the processor 122 can receive input commands. The control surfaces 134 can include touch interfaces, such as capacitive surfaces, buttons, switches, rotatory dials, or the like and enable a user to provide inputs to the audio device 100 or to the master device 133. In one embodiment, a capacitive touch interface is provided in a base or distal end of the housing 118. In another embodiment, a lower portion of the housing 118 is rotatable with respect to an upper portion or with respect to the body 110 to provide input to the audio device 100 or to the master controller. For example, a user might provide an input to change an audio track being played, to increase a volume of the audio output, or to interact with an application executing on the master device 133.

The on-board memory 124 is useable by the processor 122 for execution of programs and routines but is not configured to provide storage of audio or other data for later playback, e.g. the memory 124 cannot be used to store audio data for a plurality of songs on the audio device 100 for later playback in a manner similar to a digital music player—such tasks are reserved for the master device 133. In another embodiment, the memory 124 can be configured for storage of one or more data or audio files.

The amplifier 130 is employed by the processor 122 to provide outputs useable by a sound-production unit 136 disposed proximate the second end 114 of the body 110. The output of the amplifier 130 comprises electrical signals, which may be amplified, that are communicated to the sound-production unit 136 via an electrical wire or conductor 138 in a known manner. However, the control unit 116 might also be configured to provide outputs to the sound-production unit 136 as air pressure waves carried by a hollow conduit, or as light rays carried by fiberoptic conduits. In one embodiment, the body 110 functions as the electrical wire or conductor 138 (see FIG. 14D) or as the conduit for carrying the pressure waves or optical signals.

The microphone 132 is any available microphone useable to receive audio inputs from a user including, for example, vocalizations provided during a telephone call as well as voice commands to the master device 133 when such capabilities are present in the master device 133. Additional microphones 132 may be provided at disparate locations on the audio device 100 for use in collecting audio inputs from a user's surroundings or environment, such as in the body 110 or in the sound-production unit 136. Such audio inputs are useable by the processor 122 or the master device 133 for noise cancellation among other uses.

Figure 4:
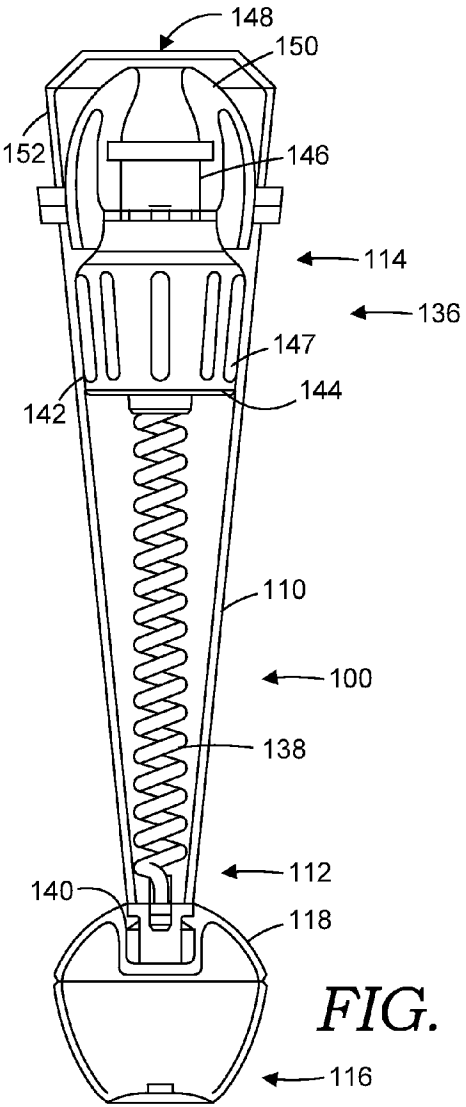
FIG. 4 is an elevational view of the audio device of FIG. 2 depicted with exterior walls removed to reveal components disposed therein.

With continued reference to FIG. 4, the control unit 116 is removeably coupled to the first end 112 of the body 110. The coupling can be a threaded coupling provided by mating threads on the first end 112 of the body 110 and a receptacle 140 in the housing 118 of the control unit 116. Or the body 110 and the housing 118 can include any of a variety of mating flanges, tabs, grooves, slots, or the like that enable snap-fit, friction-fit, magnetic fit, or other engageable couplings. The coupling places the control unit 116 in communication with the conductor 138 by, for example, placing metallic contacts on the first end 112 of the body 110 in contact with mating contacts disposed within the receptacle 140 of the housing 118.

Figure 8:
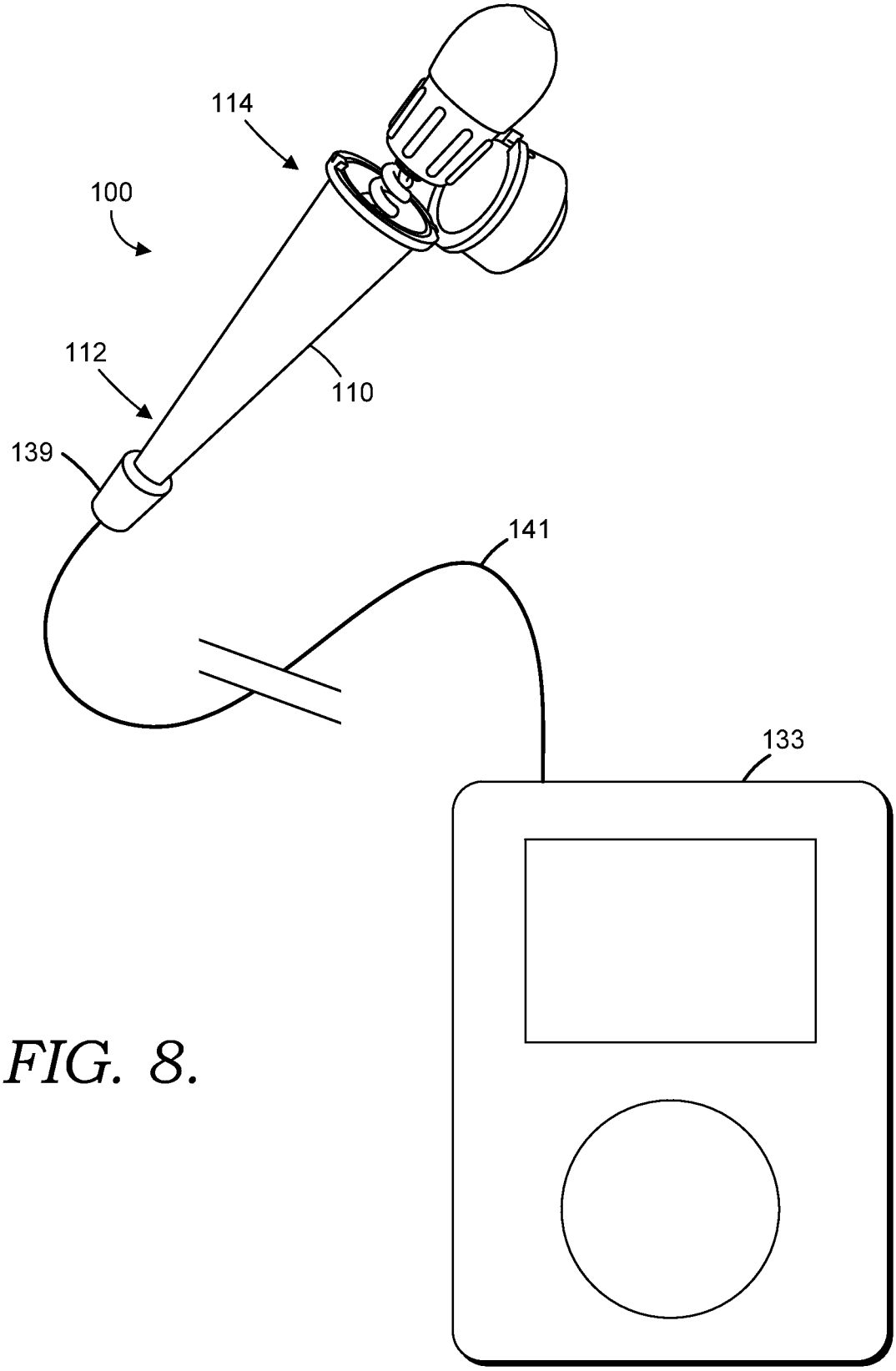
FIG. 8 is a diagrammatic view depicting a wired connection between the audio device of FIG. 2 and a master device in accordance with an embodiment of the invention.
Figure 9:
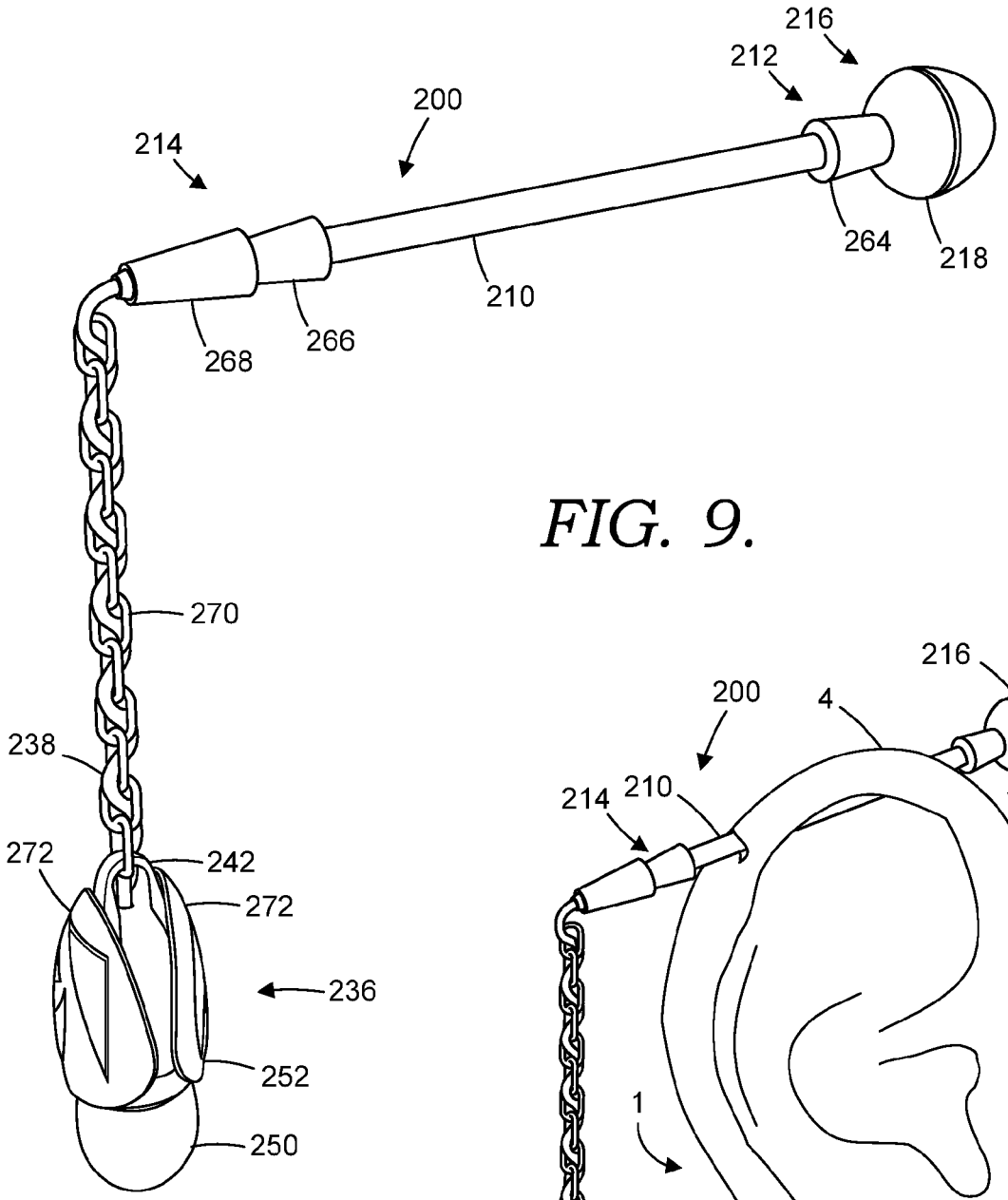
FIG. 9 is a perspective view of an audio device configured as an industrial-style earring depicted in accordance with an embodiment of the invention.

As seen in FIG. 8, the first end 112 of the body 110 may also be configured to receive a wire 141 or other conductor for connection to the master device 133 when the control unit 116 is removed therefrom. The threads, flanges, tabs, or other features on the first end 112 of the body 110 for coupling to the housing 118 of the control unit 116 as well as the contacts for coupling to the conductor 138 can be employed for coupling with a receiver 139 on an end of a wire 141. Such a wired coupling might be employed when wireless communications are restricted, e.g. such as on an airplane, but use of the audio device 100 is desired.

Figure 6:
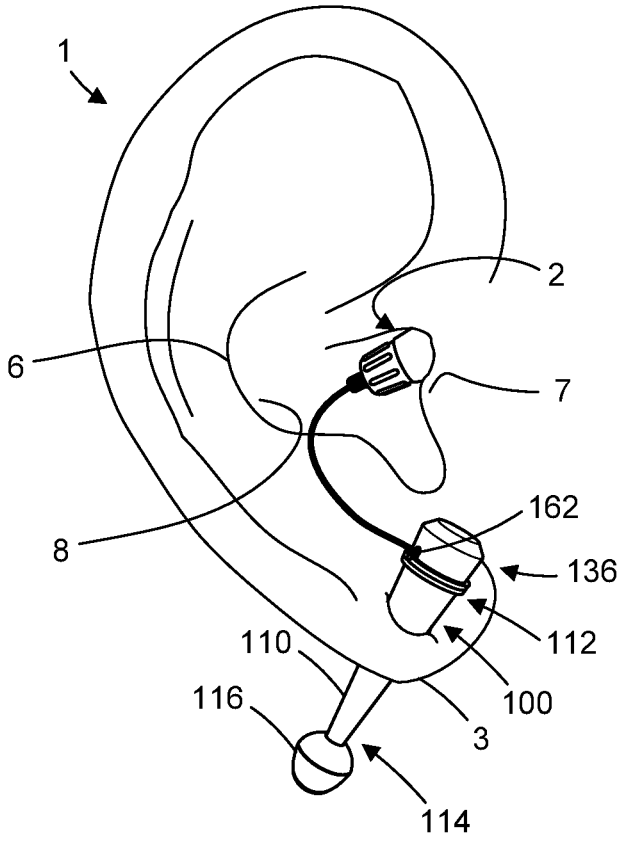
FIG. 6 depicts the audio device of FIG. 2 disposed in a piercing in the lobe of an ear with an audio-production device disposed to direct audio outputs toward the ear canal in accordance with an embodiment of the invention.

Now referring back to FIG. 4, the conductor 138 is coupled to the first end 112 of the body 110 within the interior thereof and extends through the interior of the body 110 toward the second end 114 and couples to the sound-production unit 136. The conductor 138 is flexible and may be extensible to enable the conductor 138 to extend a distance from within the body 110 sufficient to place a distal end of the sound-production unit 136 in proximity to the ear canal 2 of a user wearing the audio device 100 in the pinna 1 of the user's ear. As shown in FIG. 6, the sound-production unit 136 is disposed in the pinna 1 in a space defined by the antihelix 6, concha 8, and tragus 7 and is directed toward or into the ear canal 2.

Figure 3:
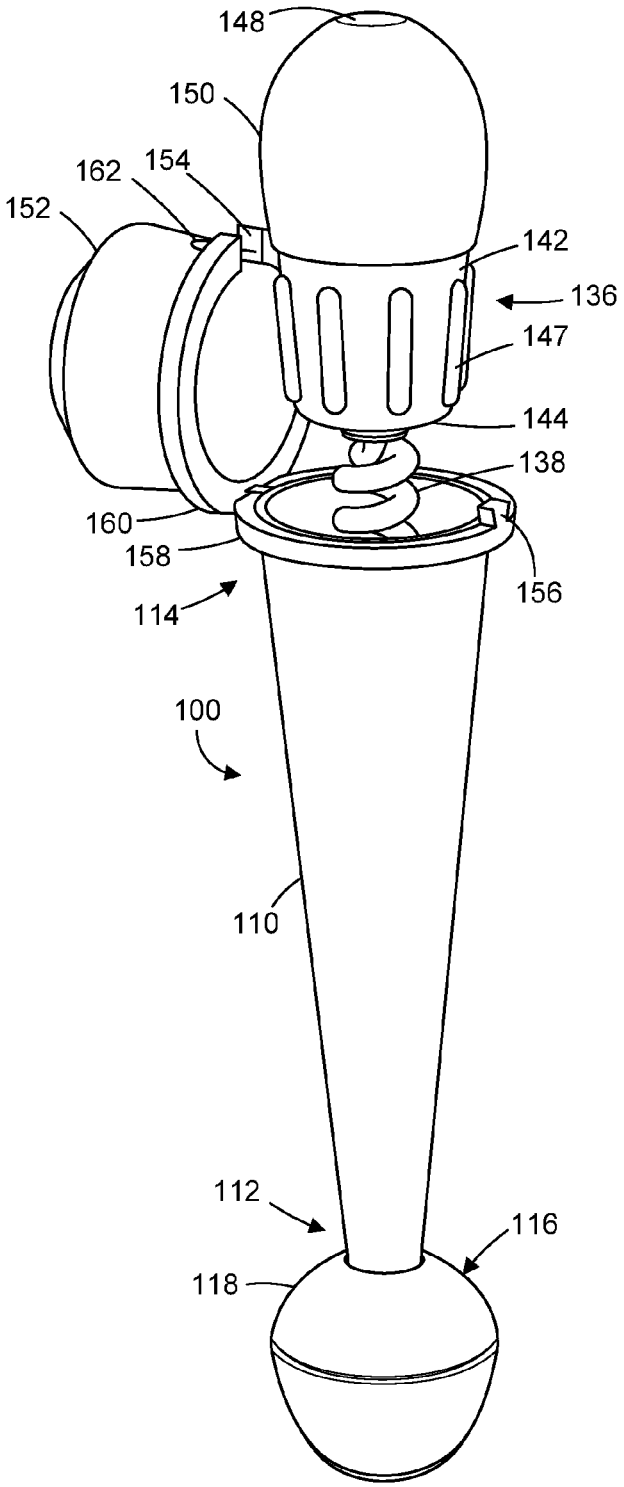
FIG. 3 is a perspective view of the audio device of FIG. 2 depicted with a cover in an open position and a sound-production unit extending from an end of the device.

As depicted in FIGS. 3 and 4 the conductor 138 is provided in a spiral or helical configuration to provide sufficient length to the conductor 138 while also enabling retraction of the conductor 138 into the body 110. The conductor 138 can alternatively be provided in any desired configuration that enables extension and retraction thereof as described herein. For example, the conductor 138 might be disposed on a coil or spool within the body 110 that feeds out the conductor 138 when needed. The conductor 138 may have a memory or may be coated with a resilient coating having a memory to at least partially bias the conductor 138 toward the retracted, spiraled configuration. Such may aid retraction of the conductor 138 into the body 110 when desired.

The sound-production unit 136 includes a housing 142 comprising a base 144 with a nipple 146 extending from a distal end thereof. The sound-production unit 136 includes a speaker, transducer, driver, or other sound production components (hereinafter referred to generally as a speaker) disposed in the housing 142 and configured to produce an audible output. Other components, such as an amplifier, microphone, or the like might also be disposed in the sound-production unit 136.

The base 144 of the sound-production unit 136 housing 142 is configured with a frusto-conical form that is dimensioned to fit within the conical shape of the housing 110 and to be received at least partially therein. As depicted in FIG. 4, the base 144 is received into the body 110 a distance sufficient to leave only a portion of the nipple 146 extending from the body 110. A plurality of ribs 147, ridges, or other protuberances are provided along the perimeter of the base 144. The ribs 147 may provide a friction-fit between the interior of the housing 110 and the housing 142 to removeably retain the housing 142 therein as well as provide a cushion between the housing 142 and the body 110. The ribs 147 may also provide an air gap between the housing 142 and the body 110 to avoid the housing 142 becoming stuck in the body 110 as a result of entrapment of air within the body 110. The ribs 147 or similar features might also be configured to provide a snap-fit, mechanical coupling, or magnetic coupling to aid retention of the sound-production unit 136 in the housing 110.

The conductor 138 is coupled to a proximate side of the base 144 of the housing 142 and to the speaker (not shown) or other components disposed therein. In an embodiment, one or more of the components of the control unit 116 may be disposed in the housing 142 and coupled to the conductor 138.

The nipple 146 extends from the distal side of the housing 142 and includes a central aperture through which sound produced by the speaker is directed and emitted from the sound-production unit 136. An exterior of the nipple 146 is configured to removeably engage an earbud 150. The earbud 150 comprises a generally dome-shaped portion of a soft, pliable material that surrounds the nipple 146 but does not substantially obstruct the central aperture 148. The earbud 150 provides cushioning to produce a comfortable fit for the user when the sound-production unit 136 is at least partially inserted in the pinna 1. The earbud 150 may also provide some frictional characteristics to aid retention of the sound-production unit 136 in the pinna 1 as well as blocking of environmental noises or sounds from entering the ear canal 2. The earbud 150 can be produced in any desired form and from available materials known in the art. For example, the earbud 150 can be uniquely molded to a particular user's pinna 1, or can be formed from a compressible memory-foam or rubber materials, among others.

A cover 152 is provided on the second end 114 of the body 110. The cover 152 is pivotally or hingedly coupled to the body 110 to enable pivoting thereof from a closed position (FIGS. 2, 4, and 6) covering and enclosing the sound-production unit 136 within the body 110 and an open position (FIGS. 3 and 7-8) in which the sound-production unit 136 can be removed from within the body 110. In another embodiment, the cover 152 is removeably coupled to the body 110 to allow the cover 152 to be detached therefrom.

The cover 152 may include a notch 154 in an edge thereof that is configured to engage a mating tab 156 or flange depending from the perimeter of the second end 114 of the body 110. Annular flanges 158, 160 are provided about the perimeters of the second end 114 of the body 110 and the cover 152, respectively, on which the notch 154 and the tab 156 can be disposed. Frictional, mechanical, and/or magnetic engagement between the notch 154 and the tab 156 releasably retain the cover 152 in the closed position. In another embodiment, a clasp or similar mechanical closure is provided to retain the cover 152 in the closed position.

As shown in FIG. 6, the notch 154 extends a distance along the sidewall of the cover 152 to provide an aperture 162 through which the conductor 138 can be disposed when the sound-production unit 136 is extended from the body 110 and the cover 152 is in the closed position. One of skill in the art will recognize other ways or forms of providing the described features; such other forms are understood as being within the scope of embodiments of the invention described herein.

With continued reference to FIGS. 2-8, operation of the audio device 100 is described in accordance with an embodiment of the invention. The audio device 100 is installed in a piercing in the pinna 1 of the user's ear as depicted in FIG. 6. In some embodiments, two of the audio devices 100 are worn simultaneously, one in each ear of the user, to provide audio outputs to each ear, such as to provide stereo sound. When the audio device 100 comprises a taper-style earring, as described previously, the audio device 100 is usually installed in a piercing in the lobe 3 of the ear. The control unit 116 is removed from the first end 112 of the body 110 and the body 110 inserted through the piercing. The audio device 100 is typically positioned with the first end 112 extending through the lobe 3 to a position between the ear and the head of the user although the reverse placement can be employed. The control unit 116 is recoupled to the body 110. Or a receiver 139 of a wired connection 141 can be coupled to the first end 112 of the body 110 and connected to the master device 133 as shown in FIG. 8.

The audio device 100 is thereby substantially captured by the interaction of the conical form of the body 110 and the enlarged dimensions of the housing 118 of the control unit 116. The dimensions of the second end 114 of the body 110 and of the housing 118 are preferably larger than that of the piercing into which the audio device 100 is inserted. The audio device 100 can be drawn at least partially through the piercing to at least partially stretch the lobe 3 and thereby provide some frictional engagement therebetween. The annular flange 158 on the body 110 can provide an additional obstruction to passage of the second end 114 of the body 110 through the piercing.

The cover 152 is pivoted to the open position and the sound-production unit 136 is withdrawn from within the body 110. The sound-production unit 136 is extended from the body 110 and placed at least partially into a space in the pinna 1 proximate the ear canal 2 and defined by the by the antihelix 6, concha 8, and tragus 7 and directed toward the ear canal 2 of the user. The sound-production unit 136 may be inserted at least partially into the ear canal 2. The conductor 138 extends from the sound-production unit 136, into the body 110 and to the first end 112 thereof to communicatively couple with the control unit 116. The cover 152 can be returned to the closed position with the conductor 138 disposed in the aperture 162. As such, the audio device 100 retains an attractive ornamental appearance of an earring during use for production of audio outputs from the sound-production unit 136.

An initial setup of the audio device 100 with the master device 133 may be carried out. The setup may include a series of communications between the audio device 100 and the master device 133 to complete processes, such as pairing among others known in the art for providing wireless communications between such devices. Description of such processes is not necessary for an understanding of embodiments of the invention and is thus not provided herein.

Using the master device 133 the user selects an audio file or track to be played by the master device 133. The master device 133 wirelessly (or through the wired connection 141) transmits or streams the audio file to the audio device 100 via the wireless communications unit 120. The wireless communications unit 120 receives the audio file for use by the control unit 116 to generate signals to the sound-production unit 136 for production of an audible output therefrom. As such, the signal path of signals embodying the audio file received from the master device 133 travels from a first side of the pinna 1, through the body 110 of the audio device 100 and thus through the pinna 1, and through the conductor 138 to the space proximate the ear canal 2 or in the ear canal 2 where the audio output is finally provided.

The user might alternatively employ the control surfaces 134 on the audio device 100 to instruct the master device 133 to begin playing a desired audio track, skip to a next or a previous track, pause, rewind, fast-forward, or stop playing an audio track. The user might also use the control surfaces 134 to navigate menus, interact with software applications, answer incoming telephone calls, provide voice commands, or the like.

When use of the audio device 100 to provide an audio output is not desired, the sound-production unit 136 and conductor 138 are returned to the body 110 and the cover 152 moved to the closed position. As such, the audio device 100 is wearable as an ornamental earring. The body 110, housing 118 of the control unit, and cover 152 can include any desired exterior ornamentation to enhance the appearance of the audio device 100. When not in use for audio output production, the sound-production unit 136 is completely enclosed and hidden from view.

Figure 10:
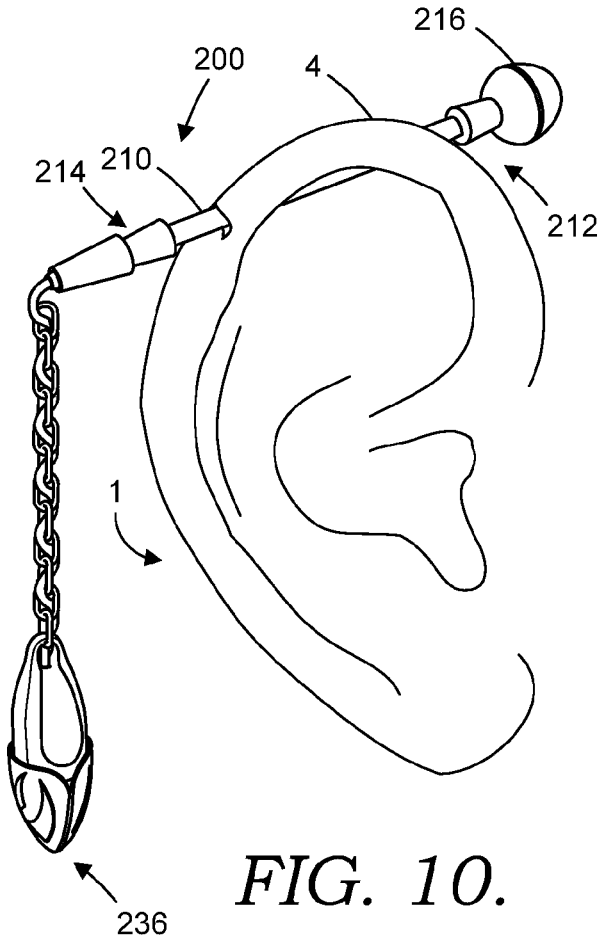
FIG. 10 depicts the audio device of FIG. 9 disposed in a pair of piercings in the helix of an ear in accordance with an embodiment of the invention.
Figure 11:
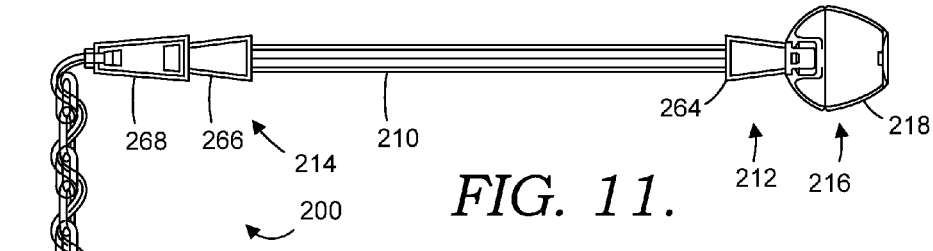
FIG. 11 is an elevational view of the audio device of FIG. 9 depicted with exterior walls removed to reveal components disposed therein.

With reference now to FIGS. 9-12, an audio device 200 is described in accordance with another embodiment of the invention. The audio device 200 is configured as an industrial-style earring. Industrial-style earrings are typically inserted through a pair of piercings in the helix 4 or other cartilaginous portions of the pinna 1, as shown in FIG. 10. The body 210 of the audio device 200 comprises an elongate cylindrical form with first and second connectors 264, 266 disposed at the first and second ends 212, 214 thereof, respectively. The first connector 264 removeably couples the body 210 with the control unit 216 and the second connector 266 removeably couples the second end 214 of the body 210 with the conductor 238 in a manner similar to that described above with respect to the audio device 100 for connecting the first end 112 of the body 110 with the control unit 116.

The first and second connectors 264, 266 are conical members having a diameter that is larger than the diameter of the body 210, but in other embodiments can have another shape and dimension. As such, when installed in the pinna 1 of the user, the first and second connectors 264, 266 may act to obstruct passage of the body 210 through the piercings. One or both of the first and second connectors 264, 266 may also be removeably coupled to the body 210 to enable removal thereof for installation of the body 210 in the pinna 1. Alternatively, the conical shape of the connectors 264, 266 may aid insertion of the connectors 264, 266 and the body 210 through the piercings by stretching of the piercings.

The conductor 238 of the audio device 200 includes a receiver 268 at a one end thereof that couples the conductor 238 to the second connector 266 and thus, to the body 210 which forms or provides a second segment of the conductor 238 extending through or along the body 210. The sound-production unit 236 is coupled to the opposite end of the conductor 238 and thus is suspended from the second end 214 of the body 210 via the conductor 238. The second segment of the conductor 238 thus continues the path of the conductor 328 between the sound-production unit 236 and the control unit 216 or to a wired coupling with a master device (see the wired coupling 141 and the master device 133 depicted in FIG. 8).

Figure 14:
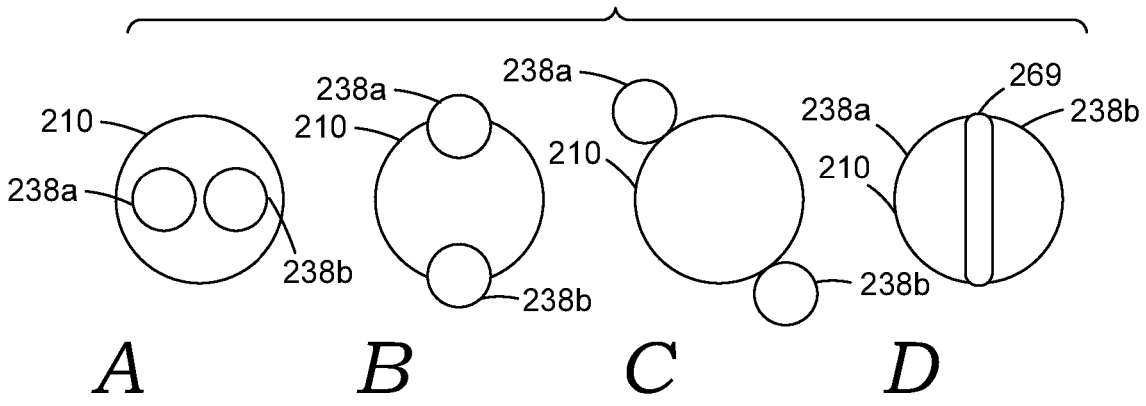
FIG. 14A depicts a positive and negative element of a conductor disposed interior to a body of an audio device in accordance with an embodiment of the invention.
FIG. 14B depicts a positive and negative element of a conductor disposed within a wall of a body of an audio device in accordance with an embodiment of the invention.
FIG. 14C depicts a positive and negative element of a conductor disposed on an exterior surface of a body of an audio device in accordance with an embodiment of the invention.
FIG. 14D depicts sidewalls of a body of an audio device forming positive and negative element of a conductor in accordance with an embodiment of the invention.

As shown in FIGS. 14 A-D, the second or other segments of the conductor 238 can take a variety of configurations. For example, FIG. 14A depicts a positive and negative conductor 238*a*, 238*b* disposed interior to the body 210 and FIG. 14B depicts the positive and negative conductors 238*a*, 238*b* disposed in a wall of the body 210. FIG. 14C shows the conductors 238*a*, 238*b* disposed on an exterior surface of the body 210 and in FIG. 14D depicts sidewalls of the body 210 functioning as the conductors 238*a*, 238*b* with an insulating member 269 disposed therebetween. It is to be understood that such configurations can also be employed in other configurations of the audio device 200, such as in the audio device 100 discussed previously.

A chain 270 or other non-extensible member can be intertwined with, disposed alongside, or otherwise associated with the conductor 238. The chain 270 may provide additional support for the sound-production unit 236 as it is suspended and/or may be provided to enhance aesthetic qualities of the conductor 238. The chain 270 may be coupled to the receiver 268 and to the base 244 of the housing 242.

Figure 13:
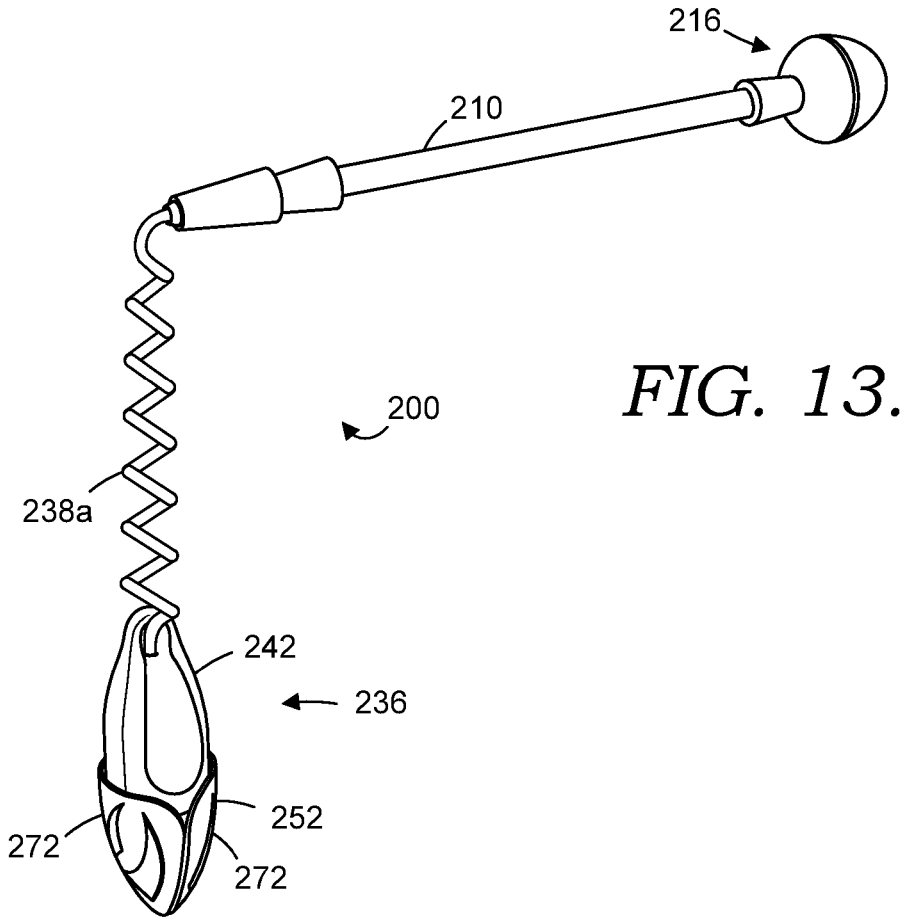
FIG. 13 is a perspective view of an audio device configured as an industrial-style earring with an extensible conductor configured in a helical form and coupling a body with a sound-production unit of the audio device in accordance with an embodiment of the invention.

As shown in FIG. 13, a conductor 238*a* comprise a resilient or extensible conductor 238*a* that has a shape memory. The conductor 238*a* has a helical or spiral form that can be elongated by pulling or stretching the conductor 238*a*. When released the conductor 238*a* will substantially resume its previous form.

Figure 12:
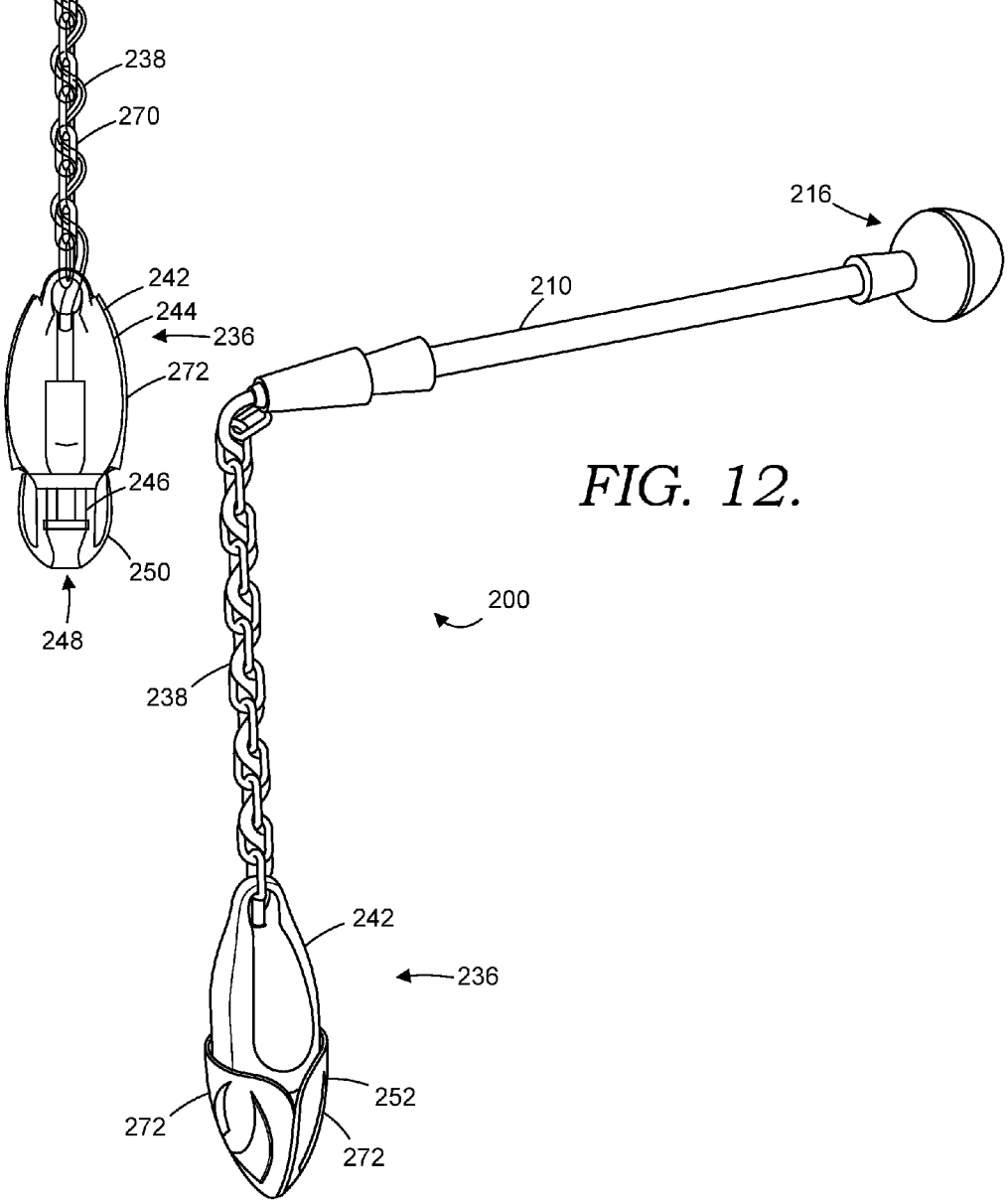
FIG. 12 is a perspective view of the audio device of FIG. 9 depicting a cover enclosing a sound-production unit.

The cover 252 comprises a pair of actuatable halves, shells, or leaves 272 that are moveable from a use position (FIGS. 9 and 11) to a non-use position (FIGS. 10 and 12). In the use position, the leaves 272 are disposed alongside the base 244 of the housing 242 to expose the earbud 250 and not interfere with insertion thereof into the ear canal 2 of the user. The leaves 272 are shaped to generally mimic the shape of the earbud 250 and the base 244 of the housing 242. As such, the leaves 272 can lie substantially alongside and in close proximity to the sides of the base 244. In the non-use position, the leaves 272 are rotated or pivoted to extend toward a distal end of the sound-production unit 236 and to substantially enclose the earbud 250 therebetween. In another embodiment, the cover 252 comprises a cap that is mechanically, or magnetically coupled to the housing 242 and may be removable therefrom.

In use, the audio device 200 is disposed in the pinna 1 of the user's ear, as depicted in FIG. 10. When use of the audio device 200 for audio output is desired, the leaves 272 are rotated from the non-use position to the use position to expose the earbud 250. The sound-production unit 236 is placed in the space proximate to the ear canal 2 and the audio device 200 is operated as described previously above with respect to the audio device 100. As such, the signal path of signals embodying the audio file received from the master device 233 travels from a first side of the pinna 1 through the body 210 of the audio device 200 and thus passes through the pinna 1 two times before passing through the conductor 238 to the space proximate the ear canal 2 where the audio output is finally provided.

When use of the audio device 200 for audio output is no longer desired, the sound-production unit 236 is removed from the space proximate the ear canal 2 and the leaves are returned to the non-use position. The sound-production unit 236 is then allowed to dangle or suspend from the second end of the body 210, as shown in FIG. 10. The housing 242, the leaves 272, and the chain 270 may be provided with an ornamental appearance to enhance the attractiveness of the audio device 200 as an earring. If desired, one or both of the conductor 238 with the sound-production unit 236 and the control unit 216 can be removed from the body 210 and the body 210 worn alone as an earring.

Figure 15:
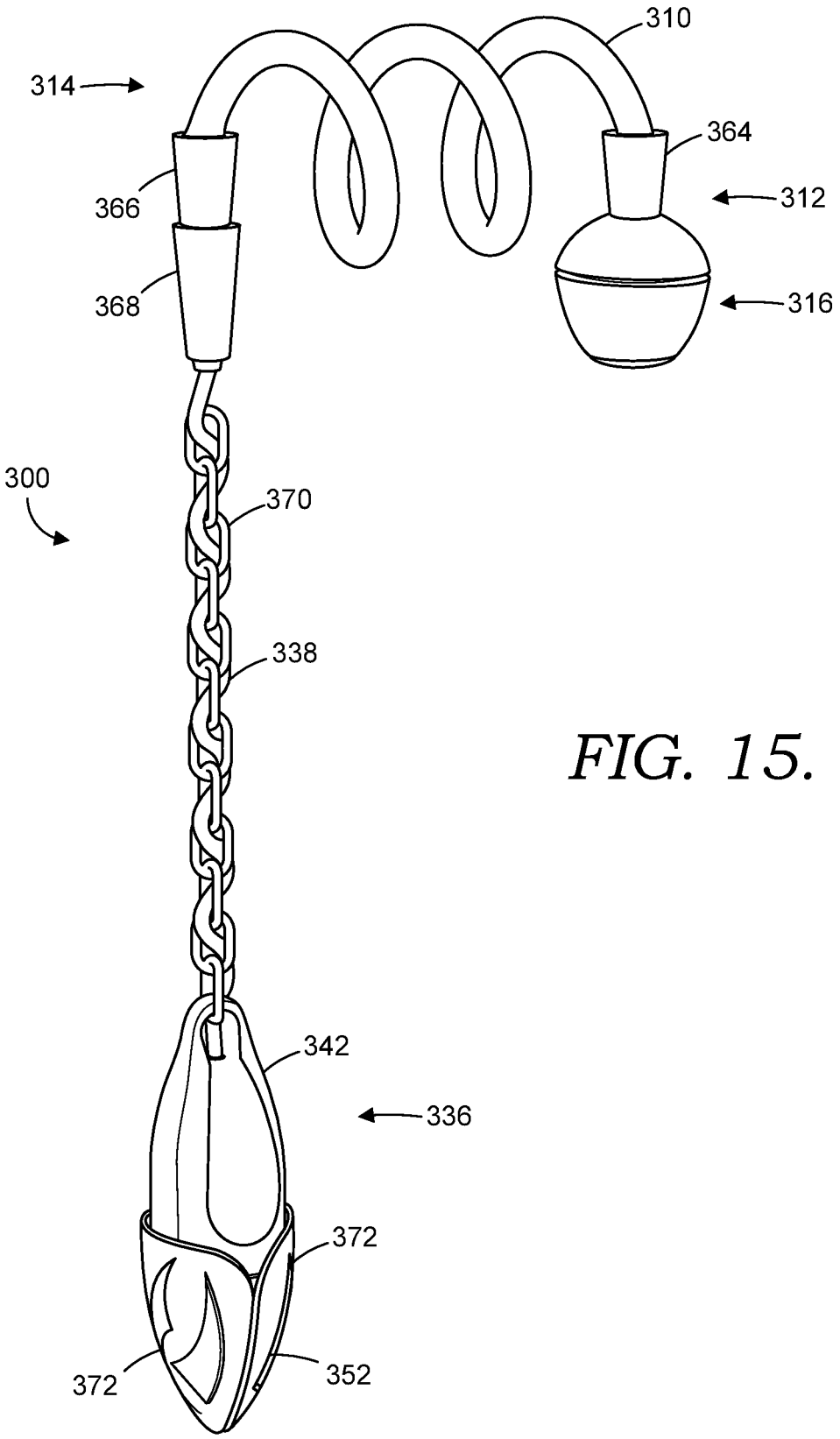
FIG. 15 is a perspective view of an audio device configured as a swirl-style earring depicted in accordance with another embodiment of the invention.
Figure 16:
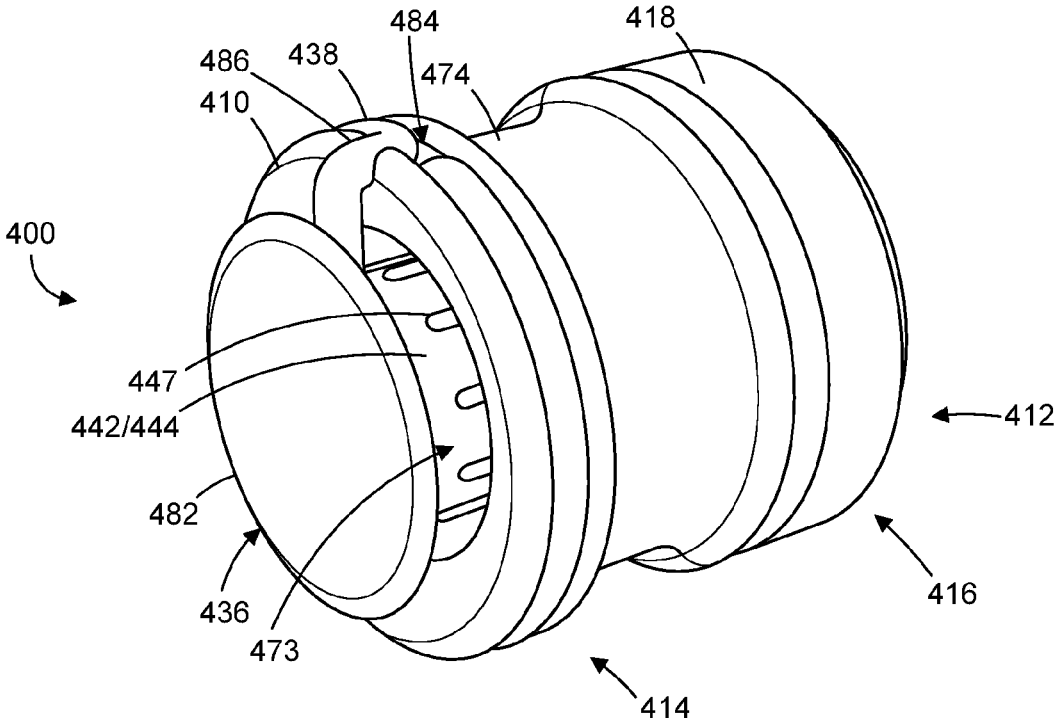
FIG. 16 is a perspective view of an audio device configured as a gauge-style earring depicted in accordance with an embodiment of the invention.
Figure 17:
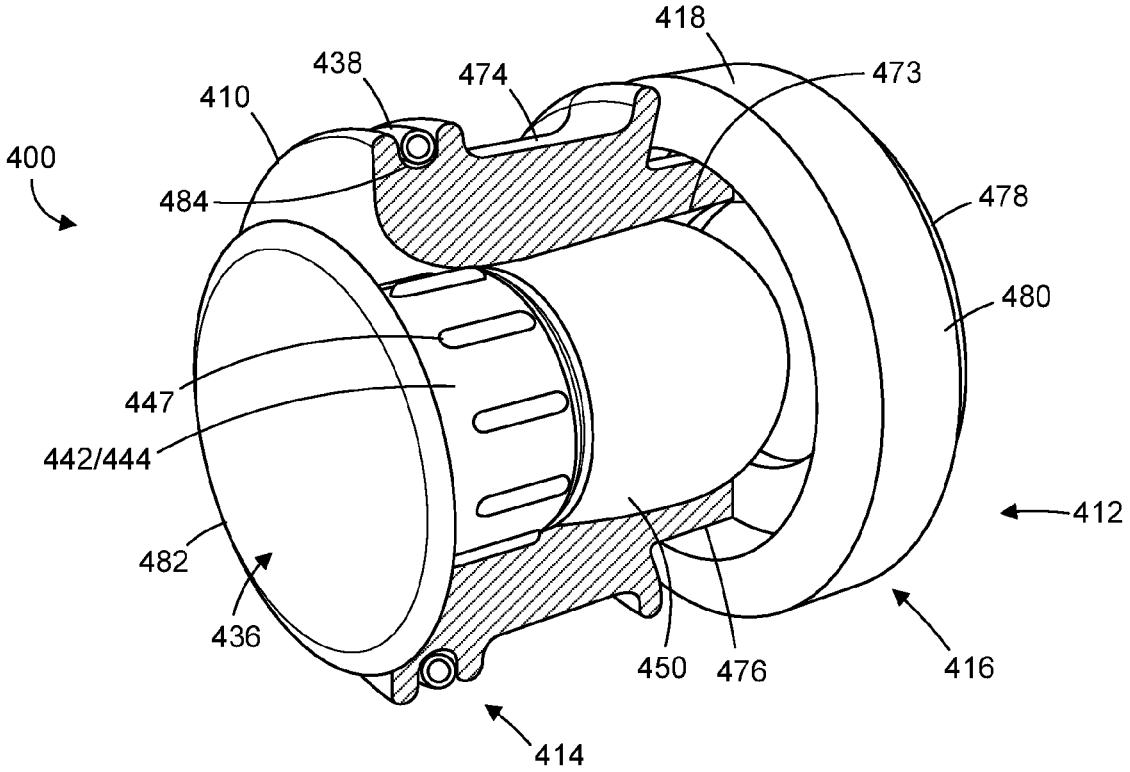
FIG. 17 is a partial cross-sectional view of the audio device of FIG. 16.

Referring now to FIG. 15, an audio device 300 is described in accordance with an embodiment of the invention. The audio device 300 is configured as a spiral-type earring. The spiral-type is similar to the industrial-type except for the body 310 thereof being provided in a spiraling or helical form. Features and operation of the audio device 300 correspond to those of the audio device 200 described previously above and are thus not described further here.

Figure 18:
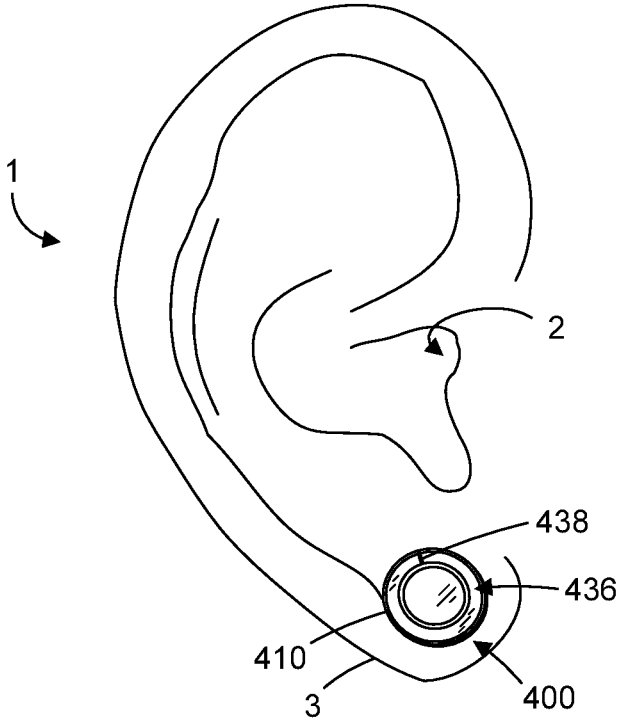
FIG. 18 depicts the audio device of FIG. 16 disposed in a piercing in a lobe of an ear with a sound-production unit in a stowed position in accordance with an embodiment of the invention.
Figure 19:
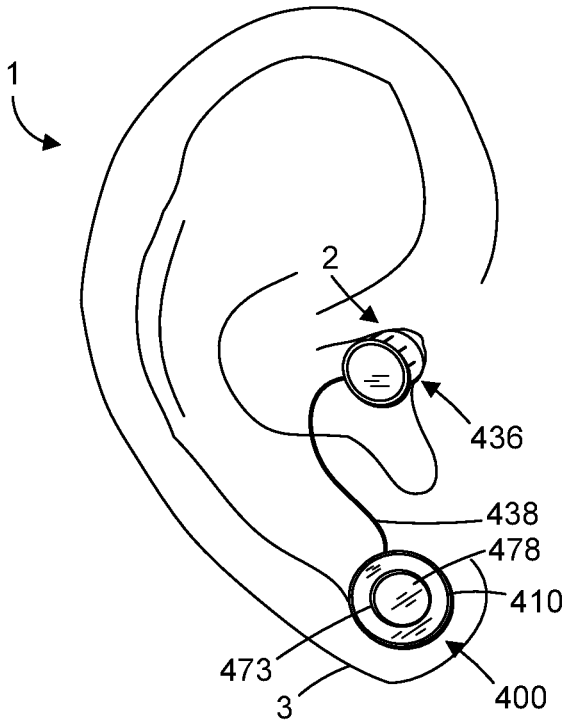
FIG. 19 depicts the audio device of FIG. 16 disposed in a piercing in a lobe of an ear with a sound-production unit extended from the body of the audio device and disposed in the ear canal of the user in accordance with an embodiment of the invention.

With reference to FIGS. 16-19, an audio device 400 is described in accordance with an embodiment of the invention. The audio device 400 is configured as a gauge-style earring and might also be referred to as a tunnel- or plug-style earring. Gauge-style earrings are configured for receipt in an enlarged piercing that is often placed in the lobe 3 as shown in FIGS. 18-19.

The audio device 400 includes a generally ring-shaped body 410 with a hollow interior passage 473 and an annular channel 474 formed about the circumference of the body 410. The annular channel 474 is configured to receive the perimeter of a piercing in the lobe 3 and to thereby retain the audio device 400 within the lobe 3. The lobe 3 is substantially contained between opposite sides or flanges forming the annular channel 474. In some embodiments, the channel 474 comprises only a slight annular recess or is not provided.

The first end 412 of the body includes an annular wall 476 depending therefrom. The control unit 416 is disposed in a cap-shaped housing 418 that includes a generally planar body 478 with a flange 480 extending normally thereto and from the perimeter thereof. The annular wall 476 is received within the flange 480 and the housing 428 to removeably couple the control unit 416 to the body 410. It is understood that other available configurations of the housing 418 of the control unit 416 and the coupling with the body 410 will be recognized by one of skill in the art—such configurations are within the scope of embodiments of the invention described herein. For example, the control unit 416 may take a form, such as that of the control units 116 and 216 that couples to a feature disposed on the first end 412 of the body 410.

The housing 442 includes a cylindrical base 444 with a plurality of ribs 447 disposed thereon. An enlarged disc 482 having dimensions larger than the base 444 is provided on the base 444 opposite the earbud 450. In another embodiment, the enlarged disc 482 is replaced by another ornamental feature, such as a spike, stud, hook, or chain, among a variety of others. Or the enlarged disc 482 may be omitted.

The conductor 438 couples to the base 444 of the housing 442 proximate to the enlarged disc 482. A groove 484, trough, or other depression is provided about the circumference of the body 410 alongside the annular channel 474. The groove 484 is configured to receive the conductor 438 therein. Alternatively, the conductor 438 can be received on the exterior surface of the body 410 without the provision of a groove or other feature to retain the conductor 438. A cutout 486 is provided in a sidewall of the groove 484 to provide for passage of the conductor 438 from the housing 442 through the sidewall and into the groove 484. As best depicted in FIG. 14, the conductor 438 can thus be disposed through the cutout 486 and into the groove 484 to wrap around the circumference of the body 410 before communicatively coupling with the control unit 416. The end of the conductor 438 opposite the sound-production unit 436 may insert into the body 410 and extend therein to a coupling with the control unit 416. The conductor 438 might alternatively insert into the body 410 to couple to a printed circuit or other electrical contact. Or the conductor 438 may be routed into the interior passage 473 and then toward the control unit 416 for coupling therewith.

The sound-production unit 436 and the conductor 438 are disposable in a stowed position (FIGS. 16-18) and a use position (FIG. 19). In the stowed position, the sound-production unit 436 is at least partially inserted into the interior passage 473 of the body 410 to place the nipple 446 of earbud 450 adjacent or in contact with an interior surface of the control unit 416. The ribs 447 may frictionally engage the wall of the interior passage 473 to retain the sound-production unit 436 in the stowed position. In the stowed position, the conductor 438 is disposed and retained in the groove 484.

To move the sound-production unit 436 to the use position as shown in FIG. 19, the enlarged disc 482 is grasped by the user and pulled to remove the sound-production unit 436 from the interior passage 473 of the body 410. A small gap may be provided between the second end 414 of the body 410 and the enlarged disc 482 to aid grasping thereof. The conductor 438 is removed from the groove 484 and the sound-production unit 436 extended and inserted into the space proximate the ear canal 2 an directed toward or into the ear canal 2.

Operation of the audio device 400 corresponds with the operation of the audio device 100 described above and is thus not described in detail here. As described previously, the signal path of signals embodying the audio file received from the master device travels from a first side of the pinna 1, through the body 410 of the audio device 400 and thus through the pinna 1, and through the conductor 438 to the space proximate ear canal 2 where the audio output is finally provided and directed toward or into the ear canal 2.

When not in use for production of audio output, the audio device 400 is wearable as a decorative earring. The enlarged disc 482, as well as the body 410 and the housing 418 of the control unit 416 can be adorned with any desired ornamentation. The enlarged disc 482 may also obscure or hide the conductor 438 extending from the housing 442 to the groove 484.

Additionally, the control unit 416 and/or the sound-production unit 436 may be detachable from the body 410 for use with a different body 410. For example, in the practice of wearing gauge-style piercings, users often slowly increase the size or gauge of the earring and thus the size of the piercing in the ear. As such, when the user wishes to increase (or decrease) the size of the body 410, a new larger body 410 is obtained and the control unit 416 and/or sound-production unit 436 are coupled to the new larger body 410. The user is thus not required to obtain an entirely new audio device 400. In an embodiment, the audio device is provided with a set of interchangeable bodies 410 of varied sizes.

In another embodiment, the audio device 400 is configured to include a connector coupled to a sound-production unit, like the connector 266 and the sound-production unit 236 discussed previously with respect to the audio device 200. Such a connector and sound-production unit may be provided instead of or in addition to the sound-production unit 436. As such, the audio device 400 could be configured with a suspended or dangling sound-production unit like that shown in FIG. 9, for example.

In use, a pair of the audio devices 100, 200, 300, 400 may be employed—one in each ear—to listen to an audio output in both ears at the same time. The pair of audio devices can comprise two like audio devices 100, 200, 300, 400 or different devices can be selected, e.g. an audio device 100 can be used in one ear while an audio device 300 is used in the other ear.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

What is claimed is:

1. An audio device worn in a piercing in a user's ear, the audio device comprising:

a body having a first end and an opposite second end and providing a hollow interior space, the body being disposed to extend through a piercing in an ear of a user;

a communication component coupled to the first end of the body;

a sound-production unit disposed proximate the second end of the body and communicatively coupled with the communication component, at least a portion of a signal path of communications between the sound-production unit and the communication component tracking the body, the sound-production unit having a stowed orientation in which the sound-production unit is removeably disposed at least partially within the hollow interior space of the body proximate to the second end thereof and a use orientation in which the sound-production unit is extended from the body and disposed at least partially within a space in the pinna of the ear defined by the antihelix, concha, and tragus of the ear of the user and the sound-production unit is directed toward the ear canal.

2. The audio device of claim 1, further comprising:

a cover coupled to the second end of the body and enclosing the sound-production unit in the stowed orientation within the body.

3. The audio device of claim 2, wherein the cover is pivotably coupled to the body or is removeably coupled to the body.

4. The audio device of claim 1, wherein the sound-production unit is coupled to the communication component by an extensible conductor that is retracted completely within the body in the stowed orientation.

5. The audio device of claim 1, wherein the sound-production unit is coupled to the communication component by a conductor that is at least partially disposed on an exterior surface of the body.

6. The audio device of claim 1, wherein the body is configured as a taper-style or gauge-style earring.

7. The audio device of claim 1, wherein the communication component is removeably coupled to the first end of the body.

8. The audio device of claim 7, wherein a second conductor is coupled to the first end of the body to communicatively couple the audio device with a master device.

9. The audio device of claim 1, wherein the sound-production unit is removeably retained in the body via one or more of a snap-fit, friction fit, magnetic coupling, or mechanical coupling.

10. The audio device of claim 1, wherein the piercing is located in the lobe of the user's ear.

11. An audio device worn in a piercing in a user's ear, the audio device comprising:

an elongate body having a first end and an opposite second end, the body being disposed to extend through a piercing in an ear of a user;

a communication component coupled to the first end of the body;

a sound-production unit flexibly coupled to the second end of the body by a conductor and communicatively coupled with the communication component, at least a portion of a signal path of communications between the sound-production unit and the communication component tracking the body, the sound-production unit having a non-use orientation in which the sound-production unit is suspended from the second end of the body and a use orientation in which the sound-production unit is disposed at least partially within a space in the pinna of the ear defined by the antihelix, concha, and tragus of the ear, and the sound-production unit is directed toward the ear canal.

12. The audio device of claim 11, further comprising:

a non-extensible member disposed between the second end of the body and the sound-production unit.

13. The audio device of claim 11, further comprising:

a connector disposed on a free end of the conductor and removeably coupled to the second end of the body, the connector enabling detachment of the sound-production unit and the conductor from the body.

14. The audio device of claim 11, further comprising:

a housing having a distal end through which sound emissions are directed, the sound-production unit being disposed within the housing; and a cover coupled to the housing that substantially encloses the distal end.

15. The audio device of claim 14, wherein the cover comprises a pair of leaves, the leaves being pivotably coupled on opposing sides of the housing and being pivotable between a first position extending from the distal end of the housing and a second position disposed alongside the housing and directed toward a proximate end thereof, the leaves substantially enclosing the distal end of the housing in the first position.

16. The audio device of claim 14, wherein the housing and the cover have an ornamental appearance and disguise the sound-production unit as a piece of jewelry.

17. The audio device of claim 11, wherein the communication component is removeably coupled to the first end of the body.

18. The audio device of claim 17, wherein a second conductor is coupled to the first end of the body to communicatively couple the audio device with a master device.

19. The audio device of claim 11, wherein the body has a shape that is one or more of cylindrical, linear, spiral, or helical.

20. The audio device of claim 11, wherein the body is disposed to extend through more than one piercing in the ear of the user.

21. The audio device of claim 11, further comprising:

a hub disposed at the first or second end of the body and connecting the body to the communication component or the conductor, respectively.

22. The audio device of claim 21, wherein the hub is removable from the body to aid installation of the audio device in the piercing in the user's ear.

* * * * *